United States Patent [19]

Gersten

[11] 3,935,402

[45] Jan. 27, 1976

[54] LOUDSPEAKER VOICE COIL ARRANGEMENT

[75] Inventor: Martin Gersten, Brooklyn, N.Y.

[73] Assignee: Ohm Acoustics Corporation, Brooklyn, N.Y.

[22] Filed: July 25, 1973

[21] Appl. No.: 382,533

[52] U.S. Cl. ..... 179/115.5 VC
[51] Int. Cl.[2] ..... H04R 9/04
[58] Field of Search ..... 179/115.5 VC, 115.5 R

[56] References Cited

UNITED STATES PATENTS

| | | | |
|---|---|---|---|
| 1,895,441 | 1/1933 | Bostwick | 179/115.5 R |
| 1,969,256 | 8/1934 | Clark et al. | 179/115.5 VC |
| 2,392,143 | 1/1946 | Graham | 179/115.5 VC |
| 3,142,786 | 7/1964 | Tsukamoto | 179/115.5 VC |
| 3,358,088 | 12/1967 | Gault | 179/115.5 VC |
| 3,792,394 | 2/1974 | Bertagni | 179/115.5 VC |

*Primary Examiner*—William C. Cooper
*Assistant Examiner*—George G. Stellar

[57] ABSTRACT

A loudspeaker voice coil assembly having improved power handling capability is disclosed. The voice coil is wound of rectangular cross section aluminum wire having flexible anodized coating. A thin anodized aluminum retaining cylinder is adhered to the winding of the voice coil with a thin coating of a cement. The anodization serves not only to electrically insulate the turns one from another and from the aluminum, heat-radiating retainer, but also serves to enhance the efficiency of the cement bonding. Voice coils capable of continuously dissipating 150 watts rms audio power have successfully been fabricated.

4 Claims, 2 Drawing Figures

LOUDSPEAKER VOICE COIL ARRANGEMENT

This invention relates to transducer windings and more particularly to the type of winding useful in the voice coils of loudspeakers or other apparatus for transforming electrical current signals into mechanical motion. In the usual loudspeaker, the mechanical motion of the voice coil is translational. The translational motion of the voice coil is imparted to the bobbin, usually of paper, on which the voice coil is mounted and the bobbin imparts its motion to the loudspeaker cone. Motion of the voice coil assembly when excited by audio frequency currents drives the loudspeaker cone to produce sound in the audible range.

It is an object of the present invention to provide a voice coil of sufficient power handling capacity to drive a loudspeaker cone of the type disclosed in Lincoln Walsh Pat. No. 3,424,873 issued Jan. 28, 1969. It is a characteristic of the Walsh loudspeaker cone that it transmits the audio signal as an ultrasonic transmission line, that is, the sound travels through the cone of the Walsh speaker at a velocity higher than that of the sound radiated to the air so that each incremental slant length of the Walsh speaker cone emits in-phase sound and so that a "coherent" sound source is produced. This type of loudspeaker requires a voice coil capable of launching a comparatively powerful mechanical impulse to the loudspeaker cone. In addition, certain other high power audio speakers would benefit from the use of a voice coil having improved power handling capabilities and it is to the satisfaction of this need as well as that of providing a high power coil for ultrasonic transducers that my invention is principally directed.

BACKGROUND OF THE PRIOR ART

A loudspeaker voice coil is conventionally a multilayer solenoid winding that is positioned in the air gap of the loudspeaker magnet. Varying audio frequency currents applied to the voice coil interact with the magnetic field in the air gap and cause the coil to undergo mechanical translational movement at an audio frequency rate. The movement is back and forth in the direction of the coil axis. Conventionally, the voice coil winding is made of rather small diameter copper wire that is glued to the outside of a thin paper cylinder or bobbin. One end of the cylinder is centered in the annular air gap between the pole pieces of the speaker magnet and the other end is centered at the apex of the felted paper composition loudspeaker cone. When the voice coil undergoes its translational motion that motion is imparted to the loudspeaker cone thus producing audible sound in the air.

Somewhat more recently, the demand for high powered loudspeakers has led to improvements in the design and construction of voice coil assemblies. For example, R. A. Gault, Patent No. 3,358,088 of December 12, 1967 shows that a somewhat higher power dissipation voice coil can be made by gluing a thin foil of aluminum to the opposite surface of the bobbin to which the winding is adhered. Gault states that while it has been suggested to make the bobbin of the voice coil of a metallic material having a sufficient thickness so as to be self-supporting, considerable difficulty has been experienced, in adhering the turns of the magnet wire forming the winding of the voice coil to the metallic material and, in that the possibility of shorting of the turns forming the winding is increased when the winding is bonded directly to the metallic material. Gault's solution was to employ a laminated paper bobbin consisting of a layer of metallic foil and a layer of paper for supporting and insulating the turns of the magnet wire. The Gault structure employed the "turns of magnet wire forming a wire on one side of a bobbin and an aluminum foil on the other side of the bobbin bonded to the bobbin for rapidly dissipating the heat generated by the voice coil."

While the Gault patent device does in fact yield a voice coil having improved thermal dissipation over that achievable with voice coils wound on conventional paper bobbins, its thermal dissipation capacity is still limited because of the need to employ paper and an enamel-insulated wire in the voice coil assembly. The need for paper was, of course, thought to be required by the need to prevent the aluminum foil from short-circuiting the turns of the voice coil winding. I have discovered, however, that an improved voice coil may be made without employing any paper in the voice coil assembly and voice coils embodying my invention have been made with many times the wattage rating of voice coils heretofore obtainable, either with the Gault structure or with other prior art arrangements.

SUMMARY OF THE INVENTION

I have discovered that a voice coil having extremely high thermal dissipation and which is therefore capable of handling the output of high wattage audio amplifiers may be made by employing rectangular cross section, flexibly-anodized aluminum wire or ribbon that is edge wound on the inside of an aluminum bobbin, the turns being bonded to each other and to the inner cylindrical surface of the bobbin with interdigitated epoxy or polyamide cement. The rectangular cross section of the wire gives the resultant solenoid greater free-standing strength and a greater metal-to-cement ratio in the area of contact between the winding 3 and the heat transferring retainer 6, than would round diameter wire copper. The use of aluminum wire having an anodized coating rather than the conventional enameled copper wire means that the thermal dissipation is limited only by the melting point of the aluminum conductor rather than by the thermal destruction point of enamel. Conventional insulating enamel employed on copper wires will carbonize or otherwise fail at about 250° C., whereas the anodized surface of the aluminum wire of my invention retains its insulating characteristics to temperatures so high as to be unmeasurable and the voice coil fails only when the aluminum wire itself melts. I have found that while the edge wound anodized aluminum voice coil winding may also be wound on the external periphery of the aluminum cylinder, placing the winding inside the cylinder allows the surface of the aluminum cylindrical bobbin to act as a more efficient heat radiator, and also gives better thermal mechanical stability since the retainer 6 then maintains the winding 3 in compression. Practical voice coil windings capable of dissipating 150 rms audio watts continuously or 250 watts programmed have been successfully built and have withstood coil operating temperatures in excess of 250° C. Three-inch diameter voice coils have been constructed weighing less than four grams in and have been installed in Walsh patent-type transducers having a flat frequency response throughout the audio range to well beyond 25 kHz. Further, the dimensional stability of the voice coil arrangement of my invention is assured from room temperature to over 250° C. because both the voice coil winding conductors and the heat dissipating bobbin are made of the same material and hence have the same coefficient of expansion.

While the most important commercial application of the transducer winding of my invention is presently in the high fidelity loudspeaker market, the need for electromechanical transducers of high power dissipation is expected to benefit from my invention inasmuch as my construction produces a coil that is weather and even salt water resistant, impervious to moisture penetration and fungus. Electromechanical transducers built with the coils of my invention may be air, water, or oil cooled.

BRIEF DESCRIPTION OF THE DRAWING

The foregoing and other objects and features of my invention may become more apparent by referring now to the detailed description and drawing in which:

FIG. 1 shows an isometric view of the voice coil assembly of my invention; and in which

GENERAL DESCRIPTION

Figure 1:
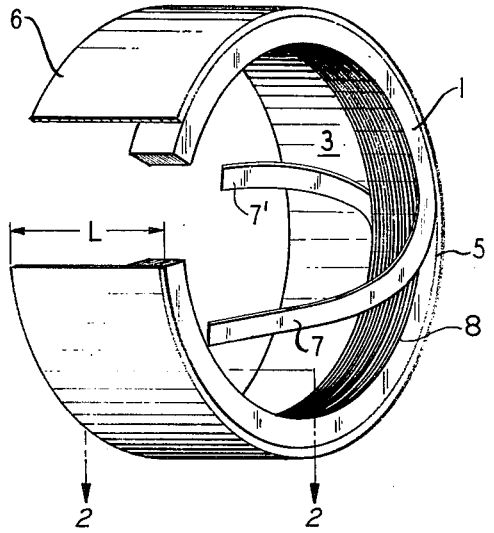

Referring now to FIG. 1, there is shown a cut away view of the voice coil assembly of my invention. An anodized aluminum wire 1, advantageously having a rectangular cross-section, is wound on its narrow edge 8 about a mandrel (not shown) until the desired number of turns have been accumulated as a winding 3. A suitable cement 5 is applied to the outside surface of the winding 3 and then an anodized aluminum strip 6 is wound over the cemented portion of the winding to maintain the turns 3 in compression. The cement 5 is allowed to dry and then the winding 3 and attached aluminum retainer bobbin 6 are removed from the mandrel. After removal from the mandrel, the ends 7, 7' are dipped in an alkali preparation such as "Easy-Off Oven Cleaner" to remove the anodizing and the ends 7, 7' are then tinned with a conventional 60–40 solder having aluminum flux. Copper leaders (not shown) may then be attached to the ends 7, 7' by conventional soldering.

It is one aspect of my invention that no additional insulation such as the conventionally-employed paper bobbin need be used to insulate the turns of the winding 3. The anodizing 1' (shown in cross-section detail in FIG. 2) of the aluminum wire 1 serve to insulate electrically each of the turns from its neighbor. The anodizing 1' of the winding 3 serves to electrically insulate the winding 3 from the aluminum retainer strip. However, because the anodized coating is thin, approximately 1 micron in the illustrative embodiment, there is good heat transference from the winding 3 to the retaining strip 6 which functions both as a heat radiator as well as a heat conductor when assembled to the metallic cone, advantageously titanium, of the Walsh-type loudspeaker. Such assembly may advantageously utilize polyamide cementing of the anodized retainer strip 6 to the metallic speaker cone. The strip 6 may, of course, be mounted internally to winding 3 with some degradation in heat radiating efficiency. The aluminum retainer strip 6 is also shown with anodized surfaces 6'. The cement 5 used to adhere the retaining strip 6 is believed to actually penetrate the surface anodization 1' of the wire 1 as well as the surface anodization of the retaining strip 6 and thus forms a very firm, interdigitated bond.

Figure 2:
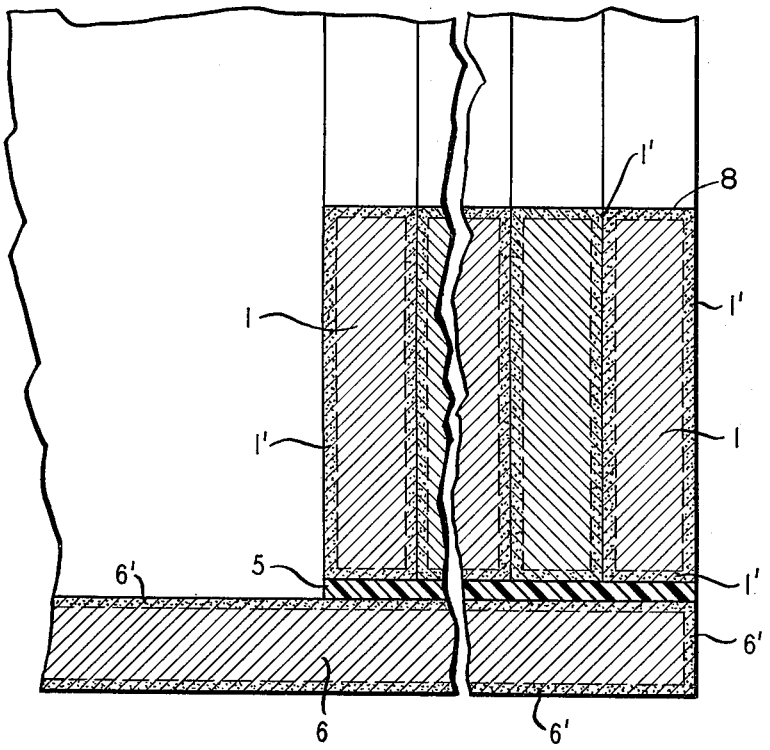
FIG. 2 shows a cross section of a portion of the voice coil assembly.

Referring now to FIG. 2, there is shown a greatly magnified and out-of-scale schematic illustrated cross-sectional view taken through the lower portion of voice coil winding 3. Both the individual turns of the aluminum wire 1 as well as the aluminum retainer strip 6 are anodized, the anodized external surfaces bearing the primed number designations 1' and 6', respectively.

In one illustrative embodiment, which has successfully been employed as the voice coil of a Walsh patent-type loudspeaker, the voice coil assembly has been fabricated with 0.006 by 0.023 rectangular anodized aluminum wire conductor. The surface anodization of this wire is of the commercially available "flexible" anodizing similar to the type used for aluminum beverage cans and aluminum foil capacitors. The winding 3 was wound on a 3-inch diameter mandrel 35 turns of which exhibited a dc resistance between the coil ends 7 and 7' of approximately 3.4 ohms. The aluminum retaining strip 6 was made of anodized aluminum ribbon of 0.004-inch thickness and had an azial length L of approximately 1 inch. A commercially available epoxy, polyamide cement 5 was employed.

The bobbin 6 of the voice coil so constructed was affixed to a titanium Walsh patent loudspeaker cone (not shown) and the coil ends 7, 7' were connected to a high fidelity, high power audio amplifier. The coil assembly successfully dissipated 150 watts rms continuously installed in the structure of the speaker. During testing, the voice coil continuously withstood operating temperatures in excess of 250° C. with no noticeable degradation in performance. Voice coils have also been built using ceramic cement which has been oven cured as well as the aforementioned air drying type of cement. Although I have illustrated a voice coil which has been wound on its edge and surrounded by an external retaining strip or bobbin former, it should be understood that it may be desirable in certain applications to wind the voice coil of rectangular wire edge-to-edge rather than "cheek to cheek" as shown in the drawing. Further and other modifications may be employed by those skilled in the art without departing from the spirit and scope of my invention.

What is claimed is:

1. A loudspeaker voice coil comprising a winding of anodized rectangular cross section aluminum wire intimately bonded to the inside of an anodized aluminum bobbin for radiating the heat of voice currents applied to said coil.

2. A loudspeaker voice coil according to claim 1 wherein said winding is bonded to said bobbin by a polyamide cement which undergoes a surface penetration of the anodized surfaces of said wire and of said bobbin.

3. A high power, high fidelity winding for the electromechanical transducer of a loudspeaker, comprising, in combination, a plurality of turns of flexibly anodized rectangular aluminum wire edge-wound in the form of a solenoid, an anodized aluminum cylindrical retainer in intimate thermally conductive contact with a cylindrical external surface of said edge-wound turns of said solenoid, said retainer mechanically constraining the turns of said solenoid against motion with respect to each other and forming a radiating surface to dissipate heat generated by the passage of excitation currents through said turns, and a high-temperature cement binder interdigitated between said turns of said solenoid and said retainer.

4. An electromechanical transducer according to claim 3 wherein said cement binder undergoes some surface penetration of the anodized portion of said aluminum wire and of said aluminum cylindrical retainer.

* * * * *